US008647400B2

(12) United States Patent
Dash et al.

(10) Patent No.: US 8,647,400 B2
(45) Date of Patent: Feb. 11, 2014

(54) BENEFICIATION PROCESS TO PRODUCE LOW ASH CLEAN COAL FROM HIGH ASH COALS

(75) Inventors: Pratik Swarup Dash, Jamshedpur (IN); Pradip Kumar Banerjee, Jamshedpur (IN); Debashish Bhattachargee, Jamshedpur (IN); Tridibesh Mukherjee, Jamshedpur (IN); Saibal Ganguly, Jamshedpur (IN)

(73) Assignee: Tata Steel Limited, Jamshedpur (IN)

( * ) Notice: Subject to any disclaimer, the term of this patent is extended or adjusted under 35 U.S.C. 154(b) by 623 days.

(21) Appl. No.: 12/682,716

(22) PCT Filed: Jun. 5, 2009

(86) PCT No.: PCT/IN2009/000328

§ 371 (c)(1),
(2), (4) Date: Sep. 28, 2010

(87) PCT Pub. No.: WO2010/026600

PCT Pub. Date: Mar. 11, 2010

(65) Prior Publication Data

US 2011/0138687 A1 Jun. 16, 2011

(30) Foreign Application Priority Data

Sep. 3, 2008 (IN) ..... 1518/KOL/08

(51) Int. Cl.
*C10L 5/00* (2006.01)

(52) U.S. Cl.
USPC ..... 44/626

(58) Field of Classification Search
USPC ..... 44/627, 280, 621, 594, 626; 423/567.1; 241/21
See application file for complete search history.

(56) References Cited

U.S. PATENT DOCUMENTS

| | | | |
|---|---|---|---|
| 3,993,455 | A | 11/1976 | Reggel et al. |
| 3,998,604 | A | 12/1976 | Hinkley |
| 4,055,400 | A | 10/1977 | Stambaugh et al. |
| 4,071,328 | A | 1/1978 | Sinke |
| 4,083,940 | A | 4/1978 | Das |
| 4,121,910 | A | 10/1978 | Stambaugh |
| 4,127,390 | A | 11/1978 | Dondelewski |
| 4,134,737 | A | 1/1979 | Yang |
| 4,169,710 | A | 10/1979 | Jensen |

(Continued)

FOREIGN PATENT DOCUMENTS

| | | |
|---|---|---|
| JP | 4623711 | 7/1971 |
| JP | 55133487 A | 10/1980 |

*Primary Examiner* — Prem C Singh
*Assistant Examiner* — Chantel Graham
(74) *Attorney, Agent, or Firm* — The Webb Law Firm

(57) ABSTRACT

A beneficiation process to produce low ash clean coal from high ash coals, including: preparing a coal slurry from fine coal and water and discharging it to a first reactor; preparing an alkali solution and discharging it to a first reactor; carrying-out a leaching reaction inside the first reactor; transferring the reaction mixture to a second reactor for filtration and washing to produce a filter cake; preparing a diluted acid solution and delivering it to a second reactor; preparing a diluted alkali solution and delivering it to a second reactor; feeding a coal slurry prepared from the filter cake into the second reactor for washing and transferring to a second filtration unit; transferring the product after filtration to a third reactor; carrying-out different leaching reaction sequences in the first, second, and third reactors; and transferring to a fifth tank the treated coal filter cake for drying.

14 Claims, 3 Drawing Sheets

(56) References Cited

U.S. PATENT DOCUMENTS

| | | | | | |
|---|---|---|---|---|---|
| 4,305,726 | A | | 12/1981 | Brown, Jr. | |
| 4,328,002 | A | | 5/1982 | Bender | |
| 4,406,663 | A | * | 9/1983 | Baldwin et al. | 44/280 |
| 4,408,999 | A | * | 10/1983 | Nadkarni et al. | 44/627 |
| 4,424,062 | A | | 1/1984 | Kamino et al. | |
| 4,516,980 | A | | 5/1985 | Wheelock | |
| 4,569,678 | A | * | 2/1986 | Simpson | 423/567.1 |
| 4,695,290 | A | * | 9/1987 | Kindig et al. | 44/621 |
| 4,900,330 | A | * | 2/1990 | Shoji et al. | 44/280 |
| 5,162,050 | A | * | 11/1992 | Knudson et al. | 44/592 |
| 5,551,640 | A | * | 9/1996 | Rajchel | 241/21 |
| 2006/0096166 | A1 | | 5/2006 | Brooks et al. | |

* cited by examiner

BENEFICIATION PROCESS TO PRODUCE LOW ASH CLEAN COAL FROM HIGH ASH COALS

CROSS-REFERENCE TO RELATED APPLICATIONS

This application is the United States national phase of International Application No, PCT/IN2009/000328 filed Jun. 5, 2009, and claims priority to Indian Patent Application No. 1518/KOL/08, flied On Sep. 3, 2008, the disclosures of which are hereby incorporated by reference in their entireties.

BACKGROUND OF THE INVENTION

1. Field of Invention

The present invention relates to an improved beneficiation process to produce low ash clean coal from high ash coals. The invention further relates to a system for implementing an improved beneficiation process to produce low ash clean/coal from high ash coals.

2. Description of Related Art

Coal and coal products continue to play an increasingly important role in fulfilling the energy needs of our society. However, it is generally known that most of the raw coals are associated with mineral matter, which makes it unsuitable for efficient utilization, such as carbonization, gasification, combustion, or liquefaction. Hence, demineralization of the raw coal has tremendous application in the metallurgical industries, thermal power plants and other industries, which require coals with low ash content. Accordingly, physical as well as chemical coal cleaning (beneficiation) processes have been explored. In general, physical coal cleaning processes involve pulverizing the coal to remove the impurities, wherein the fineness of the coal generally governs the degree to which the impurities are released. Although, the cost of preparing the coal exponentially increases with the amount of fine to be treated, there however exists an economic optimum in size reduction. Although, a step of grinding coal even to extremely fine sizes may not be effective in removing all the impurities. Based on the physical properties that effect the separation of the coal from the impurities, physical coal cleaning methods are generally divided into four categories for example, gravity, flotation, magnetic and electrical.

As compared to the techniques of physical coal cleaning, chemical coal cleaning techniques are in a very early stage of development. As far as Indian scenario is concerned, most of the coals present in India are of drift origin and low grade having high mineral matter contents varying from 5% to greater than 50%. Moreover, the mineral matter is finely disseminated inside the coal matrix and is at times firmly bound. Again, since washability characteristics of Indian coal is not good, it is difficult to remove the mineral matter from coal by conventional physical coal washing techniques based on specific gravity difference such as heavy media and dense media etc. Hence, physical methods of beneficiation such as heavy media and froth flotation, are of limited use for applications in coal beneficiation to produce low ash coals for metallurgical coke making and power generation.

Chemical leaching of coal is a fairly-known technology to produce ultra clean where the ash content of the clean is as low as ~1.0% based on mineralogical composition of the feed coal. There are potential use of this ultra clean coal both as a fuel and nonfuel.

A prior art process reveals that German coal processing plants treated coal with aqueous sodium hydroxide at elevated temperatures and pressures, and thereafter the coal was extracted with aqueous hydrochloric acid. The said process reduced the sulphur and ash content of the coal. (Crawford, BIOS Final Report No. 522, Item No. 30, Feb. 19, 1946, British Intelligence Objectives Sub-committee, London (A.T.I.—118668, Central Documents Office Wright-Patterson Airforce Base, Dayton, Ohio). Subsequently, the U.S. Bureau of Mines evaluated a similar process for treating coal, involving leaching with aqueous sodium hydroxide at 225° C., both with and without a final stage extraction with aqueous hydrochloric acid. In a report made by Reggel et al in 1972, it was concluded that the sequence of sodium hydroxide treatment and hydrochloric acid extraction removed most of the mineral matter originally present in the coal. Am. Chem. Soc. Div. of Fuel Chem. Preprints, 17(1): 44-48. Battelle Memorial Institute had developed a similar process, which is described in Stambaugh et al U.S. Pat No. 4,055,400 of 1977. According, to the said disclosure, an aqueous alkaline slurry of coal is heated at an elevated temperature and pressure to leach out sulphur and mineral matter. The Battelle process may optionally include last stage extraction with aqueous acid to reduce the final ash content. (Stambaugh et al, Hydrocarbon Processing, 54 (7): 115-116 (1975)). Another known process has undergone extensive development at Iowa State University, Ames, Iowa.

The "Ames" process uses oxidative desulphurization in aqueous slurry of sodium carbonate. Typical conditions are 0.2M $Na_2CO_3$ at an oxygen partial pressure of about 4 atmosphere and temperature of 120-140 deg. C. for 1-2 hrs. This development was reviewed in detail by Dr. T. D. Wheelock in 1981. (Chem. Eng. Commun., 12;137-159). In one representative test, using temperature of 120-140 deg. C., the total sulfur content of the coal was reduced by 70% and the pyretic sulphur content was reduced by 78%. (Wheelock (1981).

The Japanese patent publication 466/1942 describes a process for removing ash from coal or coke. The Japanese patent publication 23711/1971 discloses a process for removing sulfur and ash from coals. The Japanese patent publication 133487/1980 describes a coal deashing process. The processes of the first and second of the above-said Japanese publications, use an acid or alkali with the application of pressure and heat to dissolve the metallic components for the removal of ash. When practiced under moderate conditions, these processes fail almost to achieve any ash removing effect and are therefore not suitable as the deashing processes. The process disclosed in the third Japanese publication, the oxidation is followed by an acid or alkali treatment akin to the first and second processes and is such that the $FeS_2$ components which are difficult to dissolve are first oxidized and thereafter dissolved. A further prior art provides use of hydrofluoric acid or hydrogen fluoride gas for treatment of coal since $SiO_2$ is not easily soluble in acids or alkalis to separate Si in the form of gaseous $SiF_4$ to achieve a deashing effect. However, the use of hydrofluoric acid or hydrogen fluoride gas, which is highly toxic and corrosive, involves many difficulties. Thus an actually effective and useful process for removing ash from coal still remains to be developed although the deashing of coal is admittedly a very important technique for the effective use of coal.

The prior art also describes several chemical coal beneficiation processes, for example, U.S. Pat. No. 4,424,062 discloses a process for chemically removing ash coal by immersing ash containing coal in an aqueous solution containing hydrochloric acid or citric acid in combination with acidic ammonium fluoride. U.S. Pat. No. 3,993,455 discloses a process for removing mineral matter from coal by treatment of the coal with aqueous alkali such as sodium hydroxide, followed by acidification with strong acid. Similarly, U.S. Pat.

No. 4,55,400 discloses a method of extracting sulphur and ash from coal by mixing the coal with an aqueous alkaline solution, such as ammonium carbonate.

U.S. Pat. No. 4,071,328 discloses a method of removing sulphur from coal by first hydrogenating the coal and the hydrogenated coal was subsequently contacted with an aqueous inorganic acid solution. U.S. Pat. No. 4,127,390 discloses a process for reducing the sulphur content of coal by treatment with an aqueous sodium chloride solution. U.S. Pat. No. 4,134,737 discloses a process for the production of beneficiated coal wherein the coal is digested in caustic, then treated in mineral acid and then treated in nitric acid.

U.S. Pat. No. 4,083,940 discloses a process for cleaning coal by contacting the coal with an aqueous leaching solution containing nitric and hydrofluoric acid. U.S. Pat. No. 4,169,710 discloses comminuting and cleaning coal of sulphur and ash by contacting the coal with a hydrogen halide, such as HF (aqueous and/or anhydrous).

U.S. Pat. No. 4,408,999 discloses beneficiating coal by subjecting the coal to electromagnetic radiation in the presence of a strong inorganic acid, such as hydrofluoric acid. U.S. Pat. No. 4,305,726 discloses a chemical method of removing ash and sulphur from coal, the method comprising treating the coal with hydrochloric and hypochlorous acid in the presence of ferric and ferrous sulphate. U.S. Pat. No. 4,328,002 dislcoses a method of treating coal to remove ash and sulphur involving preconditioning coal particles in the presence of an aqueous solution of an oxidant, such as $H_2O_2$ or HF, washing the so-treated coal, treating the washed coal with further oxidant and then passivating the coal with for example, an ammonium salt and then neutralizing with alkali metal hydroxide.

U.S. Pat. No. 4,516,980 discloses a process for producing low-ash, low sulphur coal by a two-stage alkaline treatment using sodium carbonate or bicarbonate as the reagent. The alkaline treated coal is then extracted with aqueous mineral acid; and U.S. Pat. No. 3,998,604 discloses a coal demineralization process whereby ground coal is treated with aqueous acid, such as HCl, $H_2SO_4$ or $H_2CO_3$ and then subjected to froth flotation in the presence of a gas selected from $Cl_2so_2$ or $CO_2$.

All prior art described hereinabove, mostly entail high cost interalia high consumption of energy. Further, the prior art normally deals with coal containing moderately high ash-content coal but not like Indian coals which contain upto 50% of high mineral matter.

SUMMARY OF THE INVENTION

It is therefore, an object of the present invention to propose an improved beneficiation process to produce low ash clean coal from raw coal, which eliminates the disadvantages of prior art.

Another object of the present invention is to propose an improved beneficiation process to produce low ash clean coal from raw coal, which is economic and commercially viable.

A further object of the present invention is to propose an improved beneficiation process to produce low ash clean coal from raw coal, which consume less power.

A still further object of the present invention is to propose an improved beneficiation process to produce low ash clean coal from raw coal, which is eco-friendly.

A still another object of the present invention is to propose a system for implementing an improved beneficiation process to produce low ash clean coal from raw coal.

According to the invention the ash content of high ash Indian coals can be reduced up to ~4.0-5.0% in the produced clean coal. In the present invention, an improved process and system is provided for treating high ash Indian coals through a series of alkali and acid treatment steps under different operating conditions to produce low ash coal. The inventive method is implemented by a system envisaged to operate on a batch production process. Each batch is capable to process 500 kg of raw coal depending on the system configuration. In the case of chemical leaching processes for removing ash from coal, the inorganic substances constituting the ash content of coal are reacted with chemical agents and separated from the coal for removal. Various chemicals are used for the chemical beneficiation process. Some of these chemicals normally have a tendency to differentially dissolve certain inorganic constituents compared to the others and the actual chemical to be used may depend upon the inorganic content of the carbonaceous material which is fed to the process.

Leaching or solid extraction is done to dissolve mineral matter in coal using a solvent. The acidic and/or basic components present in mineral matter react with the solvents, get dissolved and then removed. According to the invention, the coal is either crushed to −30/−72 BS mesh size to produce fine clean coal or fine clean coal is obtained from flotation circuit coal, and thereafter the ash-forming minerals are removed. The removal step comprises a series of alkali and acid treatment steps under various operating conditions. The steps include treatment of the feed coal in an aqueous alkaline solution at an elevated temperature under atmospheric and elevated pressures followed by reaction/extraction with an aqueous acidic solution at atmospheric temperature and pressures. The inventive process produces low ash (~4.0-5.0% ash) clean coal from high ash Indian coals with 75-85% yield. The present invention is a step towards making chemical leaching process commercially feasible for various applications.

Accordingly, there is provided an improved beneficiation process to produce low ash clean coal from high ash coals, comprising the steps of feeding raw coal to a continuous ball mill with size reduction via a primary crusher, screening the crushed coal outputted from the ball mill; transferring the crushed and screened coal (fine coal) to a bunker having load cells for weight-monitoring of the fine coal including a vibratory device for smooth inflow, and a rotary feeder device for easy outflow from the bunker; preparing a coal slurry from the fines received in batches from the bunker in a first tank having means for stirring, and provided with process water controlled via a control valve, the tank being further supplied with compressed air, the prepared coal slurry being discharged from the tank to a first reactor, the first reactor being maintained at a temperature between 85 to 90° C.; preparing an alkali solution with a predetermined concentration with NaOH and water in a second tank; and discharging the prepared alkali solution to said first reactor; carrying-out a leaching reaction between the coal and the aqueous alkali solution inside the first reactor for about a period between 2 to 5 hours by varying the speed of the stirrer inside the first reactor; transferring the reaction mixture from the first reactor to a second reactor either directly or through a first rotary drum filter for filtration and washing to produce a filter cake including a filtrate, the filtrate being transferred to a separate storage tank, the filter cake being continuously washed by using sprayed water and transferred back to the coal slurry preparation tank; preparing a diluted acid solution in a second tank by supplying therein concentrated acid and process water via feed lines having control valves and flow sensors, the second tank being provided with at least one level sensor, and at least one stirrer, the prepared acid solution being delivered to a second reactor, the second reactor having a stirrer; preparing a diluted alkali solution in a third tank having atleast one first feed line for delivery of alkali, recycled alkali with load cells, control valves, and flow sensors, the tank having level sensors including stirrer, and atleast one second feed line for supply of process water, the produced alkali solution including recycled alkali being delivered to the second reactor; preparing a slaked lime in a fourth tank for adding the slaked lime with the recycled alkali alongwith with the fresh alkali; feeding the coal slurry prepared from said filter cake into the second reactor for washing the alkali-treated coal with acid at room temperature, and transferring to a second filtration unit for filtration; transferring the product after filtration to a third reactor; carrying-out different leaching reaction sequence in the first, second, and third reactors; transferring the treated slurry to a second filtration unit after completion of the reaction from the third reactor; transferring to a fifth tank the finally treated coal filter cake for drying, the dried filter cake being taken up for physical, chemical, rheological, petrographical analysis; and neutralizing the filtrate discharged from the second filtration unit with lime, the rest of the filtrate being transferred to an evaporator to obtain the requisite concentration of NaoH.

DETAILED DESCRIPTION OF THE INVENTION

Process Units

Figure 1:
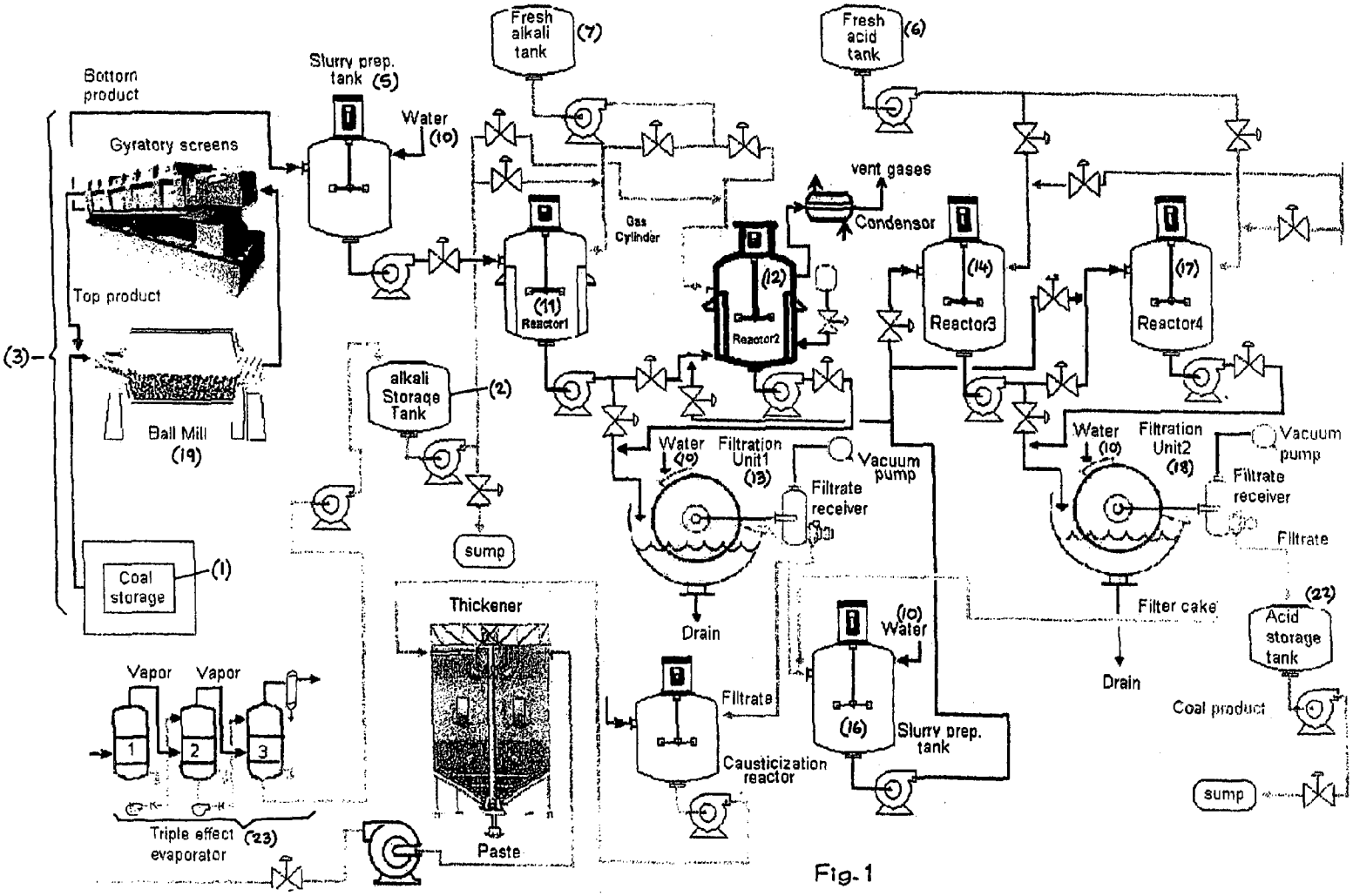
FIG. 1 shows a flow sheet of the inventive Chemical Leaching process in a system according to the invention.
Figure 2:
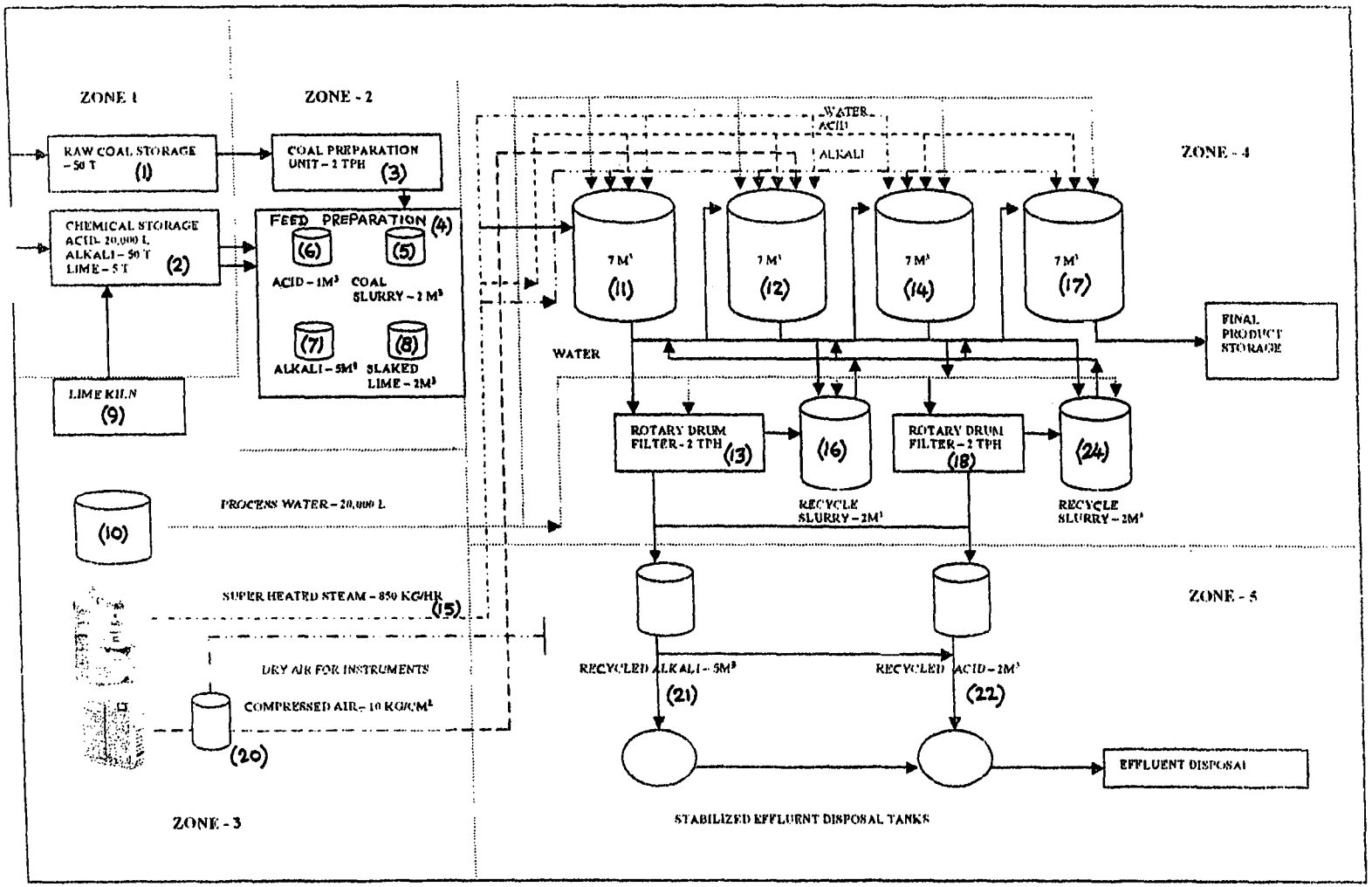
FIG. 2 shows a block flow diagram of the system for implementing Chemical Leaching process of Coal according to the invention.
Figure 3:
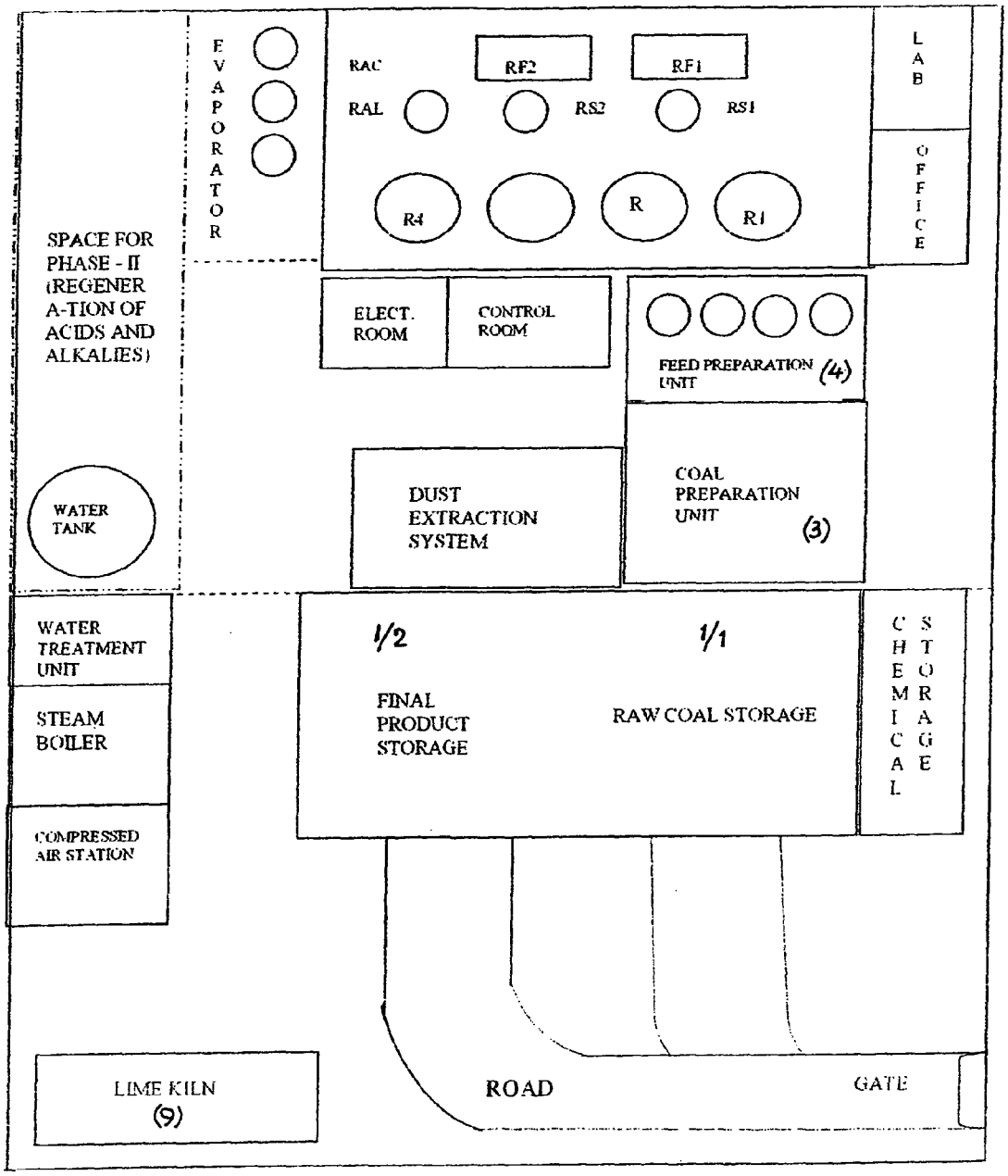
FIG. 3 shows a layout of the system adaptable for implementing a Chemical Leaching process of Coal according to the invention.

The system for implementing the inventive process is shown in FIG. 1. The system is divided into 5 zones, each zone serving the specific purpose of facilitating the various requirements for the up-gradation of the existing system. The block flow diagram which shows the five zones is depicted in FIG. 2. The proposed layout for the system is shown in FIG. 3.

As shown in FIG. 2, Zone 1 consists of a Raw material storage area (1) in the form of a covered shed which includes an area for storing raw coal, an area for storage of finished product, and a room for chemical storage (2).

The raw coal received from the mine is stored in a first part of the covered shed (1). A storage facility is made available for storing coal. The final product is stored in a second part of the covered shed (1).

A separate room is made available within the covered shed for storing the chemicals (2). Amongst the chemicals, the acids are stored in cans or drums, and the alkali is stored in racks as it is supplied in bags.

A limekin (9) is provided to generate fresh lime powder from the limestone. The limestone in the form of raw material is kept in an open area. The fresh lime from the kiln (9) is stored in covered containers. Alternatively, fresh lime form external sources can also be arranged and used.

FIG.—2 further shows the zone—2 which consists of two major units namely, a coal preparation unit (3); and a feed preparation unit (4)

Further description of the two units (3, 4) are provided hereinbelow:

a) Coal Preparation Unit (3)

The coal preparation unit (3) consists of coal conveyors, a ball mill (19) to pulverize the coal to −72 mesh (0.025 mm), a plurality of screens to separate out −72 mesh powders, and several powder storage bunkers.

The raw coal of size 0-25 mm from the storage area is provided into a number of ground hoppers and lifted to an elevation of atleast 15 m with the help of a lifting means for example, a plurality of bucket elevators and fed to a continuous ball mill (19). If the input size is larger than 25 mm, then a primary crusher to reduce the size to 0-25 mm is provided. The primary crusher when provided is disposed at the ground level.

The ball mill (19) crushes the coal to −72 mesh and the output from the ball mill (19) is screened to separate the −72 mesh material using the screens. The under size material is stored into a storage bunker while the over size material is re-circulated back to the ball mill (19).

The total capacity of the coal preparation unit (3) is variable but can be selected in the range 5-10 tph. The fine coal is stored in a bunker. The bunker is provided with load cells to continuously monitor the weight of the powder while filling and also during the discharge. The bunker is provided with a known vibratory equipment to facilitate the smooth flow of the fine material from the bunker, during discharges. The fine powders from the bunker is discharged through a rotary feeder device.

If the moisture content of the coal is high, namely, the inherent moisture or the external moisture (i.e. >5%), then a rotary dryer is provided to dry the coal before it is screened. This drier reduces the possibility of sticking and choking of the screens and the bunkers due to high moisture content of the coal.

The coal preparation unit (3) normally can be operated once a day, if the requirement to generate 2 T materials per day which caters for atleast for batch operation of 500 kg each.

b) Feed Preparation Unit (4)

The feed preparation unit (4) consists of the following submits:

a coal slurry preparation submit (5) of atleast 2 $m^3$ capacity, an acid preparation submit (6) of atleast 2 $m^3$ capacity, an alkali preparation submit (7) of atleast 3 $m^3$ capacity, and a slaked lime preparation submit (8) of atleast 2 $m^3$ capacity.

All the submits (5, 6, 7, 8) of the feed preparation unit (4) constitute a single walled circular tank fitted with stirring and agitation means of corresponding capacity. While the subunit for coal slurry preparation (5) is enabled to withstand abrasion of the coal powders and the other units to withstand the acid (6), and alkali (7). The lime units (8) are configured as acid, alkali and corrosion resistant. All the associated pipe lines, feed pumps, delivery pumps; valves (both gate valves and the control valves) are selected to be resistant to acid, alkali and corrosion.

The feed preparation tanks for the coal slurry (5), alkali (7), and the slaked lime (8) have suitable inlets for feeding the fine powders, including a gate valve for the flow control. The acid preparation tank (6) has suitable inlet for feeding the concentrated acids into the tank. Each of the tanks (5, 6, 7, 8) comprises a dilution water inlet, and a control valve for flow control. Each of the tanks is provided with atleast one level sensor for control purposes. Each of the tanks is also provided with a manually operable sample collection point.

1) Coal Slurry Preparation Unit (5):

The coal slurry preparation tank may be selected as a circular tank of around 2 $m^3$ capacity. The tank is fitted with a stirring mechanism to stir the material while the slurry is being prepared. The slurry prepared may be in the form of dough or cake or thick slurry and hence heavy capacity stirrers are provided.

The coal slurry preparation tank (5) has an inlet pipe for feeding the coal powder into the tank. The feed is controlled through a gate valve, which also acts as an isolation valve for the sealing purpose. The process water is fed to the tank and the feed line is provided with a control valve. The tank (5) is further provided with level indicators for control purpose.

The coal slurry prepared in the tank (5) may be lime dough or cake or thick slurry and requires forced discharge from the tank (5). A compressed air line (20) is provided to pressurize the tank (5) to facilitate discharging of the slurry out of the tank (5). The outlet of the tank is provided with a gate valve. The valve also acts as an isolator of the tank apart from controlling the flow.

The output from the coal slurry tank (5) is transported to the reactor zone.

The coal powder from the storage bunker (1) is fed to the slurry preparation tank (5), in batches of 500 kg coal powder. The feeding may be controlled by both the load cell data at the coal powder storage bunker (1) and also by the level sensor of the slurry tank (5). Once the coal powder is taken into the tank (5), the process water (10) is fed to the tank (5) in a controlled manner to make the slurry of required composition. The flow of water is controlled through the flow control valve provided on the tank (5), and the level sensor signal. The mixture is continuously stirred while the material is being added.

Once the slurry is made, the outlet gate valve is opened and the outflow of the slurry form the tank (5) is transferred by using the compressed air (20) which ensures complete emptying of the tank (5).

2) Acid Preparation Subunit (6):

The tank (6) used for the acid preparation is provided with an inlet for the feed, an inlet for the process water (10), a stirrer, and an outlet. Each of the feed lines for the acid, water and the outlet may be provided with control valves to regulate the feed inlet and also the pipe lines may be provided with flow sensors. The tank (6) is provided with level sensors. The acid inlet and the outlet of the tank (6) is each provided with pumps to feed and evacuate the material.

The tank, valves, pumps, flow and level sensors are selected to be acid resistant. The concentrated acid from the storage tanks in the storage area (2) is pumped to the acid preparation tank (6) in the required quantities for preparation of diluted acids with various degrees of dilutions. The process water (10) is used to prepare the necessary diluted acids. The contents in the tank (6) are stirred while the diluted acids are prepared.

The final diluted acid is then pumped with the help of pumps to a second reactor and the flow is controlled through the control valves in the outlet pipe line.

3) Alkali Preparation Subunit (7):

The tank (7) used for the alkali preparation is provided with a hopper meant for the feed alkali, a plurality of inlet pipes for the process water (10), including the recycled alkali (21), and an outlet for the alkali solution. The hopper is further provided with load cells for measuring the amount of alkali entering into the system so that requisite alkali concentration can be maintained inside the tank (7). Each of the feed lines for water (10) including that of the outlet may be provided with control valves to regulate the feed inlet. The pipe lines may be provided with flow sensors. The tank (7) is provided with level sensors. The tank (7) outlet is provided with pumps to feed and evaluate the material.

The tank, valves, pumps, flow and level sensors are all alkali resistant. The concentrated alkali from the storage area (2) is charged through the hopper to the alkali preparation tank (7) in the required quantities for preparation of diluted alkali with various dilutions. The process water (10) is used to prepare the diluted alkali. The contents in the tank (7) are stirred with a stirrer while the diluted alkali is being prepared.

The final diluted alkali is then pumped with the help of pumps to a second reactor and the flow is controlled through the control valves in the outlet pipe line. In addition to the fresh alkali, recycled alkalis are also added to the second reactor.

4) Slaked Lime Preparation Subunit (8):

The tank (8) used for the slaked lime preparation is provided with a hopper for the feed, an inlet for the process water, a stirrer, and an outlet. The hopper is provided with load cells for measuring the amount of lime entering into the system so that requisite lime concentration can be maintained inside the tank (8). Each of the feed lines for water (10) and the outlet may be provided with control valves to regulate the feed inlet. The pipe lines may be provided with flow sensors. The tank is provided with level sensors. The tank (8) outlet is provided with a pump to feed and evacuate the material.

The tank, valves, pumps, flow and level sensors are selected to be corrosion resistant.

The lime from the storage area (2) is charged through the hopper to the slaked lime preparation tank (8), in the required quantities for preparation of lime with various dilutions. Process water (10) is used to prepare the necessary slaked lime. The contents in the tank (8) are stirred while the lime is being prepared.

The final slaked lime is then added to the recycled alkali to precipitate out calcium silicates. The precipitate is prepared inside a thickener and the regenerated alkali is recycled back and charged to a third reactor along with fresh alkalis (7).

Methodology to be Followed for Chemical Leaching of Minerals in a System of the Invention Description for Chemical Leaching Process Coal Sample Preparation The feed can be fine clean coals generated in coal washeries through froth flotation process or a middling product. The feed sample can be taken directly as obtained after froth flotation treatment if the size requirement in −30 BS mesh or can be crushed to −72 BS mesh size (0-025 mm) for improving the kinetics of the process. The coal samples are analysed for their ash content before processing. The major minerals normally found in coals are silicates or shales, quartz and/or sandstone, pyrites and carbonates such as siderites and ankerites. It has been found that even at 373 deg. K using diluted to moderately concentrated NaOH solution, kaolin is converted into a crystalline sodium derivative i.e. $Na_2O.Al_2O_3.I.8SiO_2$. The solubility of this sodium-aluminium-silicate derivative is not very high in alkali solutions but it is fairly soluble in diluted alkali followed by washing with mineral acid.

Chemicals:

Commercially available sodium hydroxide (NaOH) pellets in combination with hydrochloric acid (HCl) are to be used in the present method. Diluted aqueous NaOH solution of 10-50% concentration and 10-20% HCl is prepared and used for the chemical leaching process described below:

The Treatment Process:

Feed coal is collected form the coal storage (1) and fed into a hopper using a bucket elevator. The coal is allowed to enter into a ball mill (9) from the hopper in which it is crushed to desired size range by allowing sufficient residence time. The crushed coal is then be screened to obtain −30 BS mesh and/or −72 BS mesh size. Oversize coal at the top of the screen is recycled back to the ball mill (19). The product from the screen is stored in a storage hopper around of 2 t capacity.

The coal powder from the storage hopper is fed into the slurry preparation tank (5). In the slurry preparation tank (5), 500 kg of feed coal is mixed with 1000-3000 litres of water using an agitator. The coal slurry is then pumped to a first reactor (11). In the other tank (7), alkali solution of a particular concentration is prepared (500-2500 kg NaOH in 2000-4000 litres of water) so as to maintain aqueous alkali concentration of 10-50% inside the first Reactor (11). The coal slurry as well as the prepared alkali solution is fed into the first reactor (11) of capacity around 7.0 $Nm^3$. The first reactor (11) is a jacked reactor having an agitator in which temperature up to ~100° C. can be achieved at atmospheric pressure. In all the above preparation tanks, (5, 6, 7, 8) the agitator speed is maintained at around 200 rpm, to facilitate proper mixing.

In the first Reactor (11), the temperature is maintained at 85-90° C. by using saturated steam inside the jacket. The leaching reaction of coal with aqueous NaOH solution is carried out inside the first reactor (11) for a period of nearly 2 to 5 hr based on requirement of reduction in mineral matter percentage in coal and for achieving optimum leaching sequence in the series of reactors. The stirrer speeds inside the reactors can be varied using a variac for homogenous mixing of the coal slurry with the NaOH solution. A condenser is mounted at the top of the first reactor (11) for continuous reflux. After completion of reaction in the first reactor (11), the reaction mixture can be sent to a second reactor (12) directly or through a first rotary drum filter (13) for filtration under vacuum and washing.

The filter cake that is formed on the filter cloth of the first rotary drum filter (13) is continuously washed with wash water (10) so as to remove the silicates and other products those are formed as a result of reaction of the mineral matter constituents with NaOH. Water washing is done by spraying water (10) from the top of the first rotary drum filter (13). The filter cake that comes out of the first rotary drum filter (13) is sent for preparation of coal slurry (16). Filtrate coming out of the first rotary drum filter (13) is pumped to a separate storage tank.

The coal slurry (16) prepared from the filter cake is then pumped to the second reactor (12) or an acid reactor (14). A pressure of 10 $kg/cm^2$ is maintained inside the second reactor (12) by circulating compressed air (20) into the reactors (12, 14). At the highest pressure, a temperature of nearly 180° C. can be reached by injecting steam (15) through the jacket. Inside the first Reactor (12), 150-170° C. temperature is maintained. Here, the stirrer speed inside the first reactor is maintained at around 200 rpm. A condenser/cooling coil arrangement is present at the top of the first reactor (12) for continuous reflux. After completion of reaction time, the product from the first reactor (12) is again sent back to the first filtration unit (13) for filtration. Filtration is carried out in the similar way.

The slurry prepared using the filter cake can also be fed into the acid Reactor (14) which is a reactor for treating coal slurry with 5-20% of HCI at room temperature and atmospheric pressure. This acid reactor (14) is used for washing/treating alkali treated coal with acid so that most of the dissolved silicates and other reaction products gets washed away. Here also, the stirrer speed inside the acid reactor (14) is maintained at around 200 rpm. Then the acid treated coal is sent to a second filtration unit (18) where filtration is carried out. Product after filtration from the second Reactor (12) or acid reactor (14) based on sequence maintained may then be sent to a third Reactor (17) if required which is an acid reactor similar to the Reactor (14). There is an arrangement for maintaining different leaching sequence i.e. alkali-acid-alkali-acid as well as alkali-alkali-acid-acid using the four reactors.

After completion of reaction in the third reactor (17), the slurry (16) is sent to the second filtration unit (18) (rotary drum filter 2). Filtration is carried out in the same way, as was done using the first filtration unit (13). The coal filter cake obtained after the final treatment is stored inside a fifth tank and after drying the same is sent for various physical, chemical, rheological, petrographical and other special analysis. The alkali and acid filtrates are sent to two different storage tanks.

The filtrate coming out from the filter (18) after alkali treatment is neutralized with lime to precipitate out the silicates and other undesirable constituents. The rest of the filtrate which contains mostly pure NaOH is sent to a triple effect evaporator (23) to obtain requisite concentration of NaOh. The concentrated NaOH solution (coming out of the evaporator) is pumped back to a recyclable NaOH storage tank from which it is again charged into the reactor along with fresh alkali solutions. Similarly, the filtrate coming out after the acid treatment is recycled back to a recycle acid storage tank. After particular number of tests when the acids get contaminated with impurities, the spent acid is discharged into a storage tank in the product disposal section from which it is sent to a tanker and disposed off in a safe place.

Requirement of Services:

Approximately 500 kW peak power requirement is estimated for the total plant operation. No emergency power facility is proposed since the operations are batch processes. Approximately 30,000 litres of 25-cubic m of water (10) requirement is estimated per day for the steam generation (15), process as well as wash water (10). A water storage tank of suitable capacity is provided to facilitate uninterrupted supply of water to the various units. The water is selected to be soft having not more than 10 ppm hardness. If the water available is hard, the same is provided with suitable softening equipment.

Steam (15) is used as the heating medium for the reactors. Approximately, 800 kgs/hr of superheated steam at 250° C. and a pressure of 15 $kg/cm^2$ is estimated. The steam is used to heat the material in the reactors upto 185° C.

Compressed air (20) is arranged to pressurize the pressure reactor at 10 kg pressure. Compressed air is also used for pneumatically activated control valves.

A buffer storage tank for compressed air water compressed air with 5000 litres capacity is provided to facilitate uninterrupted supply of compressed air to the plant units. Suitable dryer arrangement is provided to supply dry compressed air (20) to the control valves.

Modes of Operation:

According to the invention, three modes of operation can be made available for the leaching process. Any of the operation modes can be finally adopted and the process optimized for achieving the maximum reduction of ash content in the coal. The details of the three different modes of operation are shown in Annexure—1.

Final Product

The coal cake obtained after the final treatment and filtration in the second rotary vacuum filter (18) is collected separately. The coal cake is expected to have a moisture content of about 20%. The cake is air dried to reduce the moisture and then bagged in 1 tonne jumbo bags. The bags are then stored in product storage area for further transportation to the user. The coal cake samples from each batch are collected and analyzed for various physical, chemicals, rheological, petrographical and other special analysis.

We claim:

1. An improved beneficiation process to produce low ash clean coal from high ash coals, comprising the steps of:

(a) feeding raw coal to a continuous ball mill with size reduction via a primary crusher, (b) screening the crushed coal output from the ball mill;

(c) transferring the crushed and screened fine coal to a bunker having load cells for weight-monitoring of the fine coal including a vibratory device for smooth inflow, and a rotary feeder device for easy outflow from the bunker;

(d) preparing a coal slurry from the fine coal received in batches from the bunker in a slurry preparation tank having means for stirring, and provided with process water controlled via a control valve, the tank being further supplied with compressed air, the prepared coal slurry being discharged from the tank to a first reactor, the first reactor being maintained at a temperature between 85° C. to 90° C.;

(e) preparing an alkali solution with a predetermined concentration from NaOH and water in a first tank; and discharging the prepared alkali solution to said first reactor;

(f) carrying-out a leaching reaction between the coal slurry and the aqueous alkali solution inside the first reactor for about 2 to 5 hours by varying the speed of a stirrer inside the first reactor to form a reaction mixture;

(g) transferring the reaction mixture from the first reactor to a second reactor either directly or through a first rotary drum filter for filtration and washing to produce a filter cake and a filtrate, the filtrate being transferred to a separate storage tank, the filter cake being continuously washed by using sprayed water and transferred back to a coal slurry preparation tank;

(h) preparing a diluted acid solution in a second tank by supplying therein concentrated acid and process water via feed lines having control valves and flow sensors, the second tank being provided with at least one level sensor, and at least one stirrer, the prepared acid solution being delivered to a second reactor, the second reactor having a stirrer;

(i) preparing a diluted alkali solution in a third tank having at least one first feed line for delivery of recycled alkali, a hopper with load cells, control valves, flow sensors, level sensors, a stirrer, and at least one second feed line for a supply of process water, the produced alkali solution including recycled alkali being delivered to the second reactor;

(j) preparing a slaked lime in a fourth tank for adding the slaked lime with the recycled alkali along with the fresh alkali;

(k) feeding a coal slurry prepared from said filter cake into the second reactor for washing the alkali-treated coal with acid at room temperature, and transferring to a second filtration unit for filtration;

(l) transferring a product after filtration to a third reactor;

(m) carrying-out different leaching reaction sequences in the first, second, and third reactor;

(n) transferring the treated slurry to a second filtration unit after completion of the reaction from the third reactor, producing a filter cake and a filtrate;

(o) transferring to a fifth tank the finally treated coal filter cake for drying, the dried filter cake being taken up for physical, chemical, rheological, and petrographical analysis; and (p) neutralizing the filtrate discharged from the second filtration unit with lime for precipitation and transferring the rest of the filtrate to an evaporator for concentration of NaOH.

2. The process according to claim 1, wherein coal crushed in batches of 500 kg to −30 or −72 BS mesh size or a fine coal obtainable from floatation circuit coal is used.

3. The process according to claim 1, wherein the coal slurry is prepared in the form of a dough, a cake, or a thick slurry by mixing the prepared coal with process water.

4. The process according to claim 1, wherein the alkali is sodium hydroxide (NaOH).

5. The process according to claim 1, wherein the acid is hydrochloric acid or sulphuric acid.

6. The process according to claim 1, wherein the alkali concentration is 10-50% and the acid concentration is 10-20%.

7. The process according to claim 1, wherein the treatment steps in the reactors comprise a treatment of the feed coal in an aqueous alkaline solution at an elevated temperature under atmospheric pressure and elevated pressure followed by reaction/extraction with an aqueous acidic solution at atmospheric temperature and pressures.

8. The process according to claim 1, wherein the stirrer speed inside the reactors is maintained at around 200 rpm.

9. The process according to claim 1, wherein process water having not more than 10 ppm hardness is used.

10. The process according to claim 1, wherein pressure in the first reactor is created by the compressed air supplied at a pressure of 10 $kg/cm^2$.

11. The process according to claim 1, wherein the coal filter cake obtained after final treatment contains 20% moisture and is air dried to reduce the moisture.

12. The process according to claim 1, wherein coal ash is reduced up to 4-5% by weight with a yield of around 75-80% after leaching.

13. The process according to claim 1, wherein different leaching sequences are used in the reactors.

14. The process according to claim 1, wherein a super heated steam is used to heat the coal slurry in the first reactor.

* * * * *

UNITED STATES PATENT AND TRADEMARK OFFICE

CERTIFICATE OF CORRECTION

PATENT NO. : 8,647,400 B2
APPLICATION NO. : 12/682716
DATED : February 11, 2014
INVENTOR(S) : P. S. Dash et al.

It is certified that error appears in the above-identified patent and that said Letters Patent is hereby corrected as shown below:

Title Page, Item (75) Inventors, Line 3, delete "Bhattachargee" and insert -- Bhattacharjee --

Signed and Sealed this
Twelfth Day of August, 2014

Michelle K. Lee

Michelle K. Lee
*Deputy Director of the United States Patent and Trademark Office*